US005156717A

United States Patent [19]

Honnorat et al.

[11] Patent Number: 5,156,717

[45] Date of Patent: Oct. 20, 1992

[54] NON-FLUORESCENT FORGERY-PROOF SAFETY PAPER AND DOCUMENT OBTAINED

[75] Inventors: André G. A. Honnorat, Annecy le Vieux; Claude R. Riou, Veyrier du Lac, both of France

[73] Assignee: Aussedat-Rey, Velizy Villa Coublay, France

[21] Appl. No.: 446,586

[22] Filed: Dec. 6, 1989

[30] Foreign Application Priority Data

Dec. 7, 1988 [FR] France ..... 88 16347

[51] Int. Cl.[5] ..... D21H 21/40

[52] U.S. Cl. ..... 162/140; 162/158; 162/181.2; 162/181.3; 427/7; 428/916

[58] Field of Search ..... 162/140, 158, 181.2, 162/181.3; 283/95; 427/7; 428/916

[56] References Cited

U.S. PATENT DOCUMENTS

| | | | |
|---|---|---|---|
| 670,511 | 3/1901 | Friese-Greene et al. | 162/158 |
| 673,400 | 5/1901 | Kretschmann | 162/140 |
| 1,804,978 | 5/1931 | Genoese | 162/140 |
| 2,005,105 | 6/1935 | Neff | 162/140 |
| 2,075,538 | 5/1937 | Neff | 162/140 |

FOREIGN PATENT DOCUMENTS

| | | | |
|---|---|---|---|
| 635442 | 8/1936 | Fed. Rep. of Germany | 162/140 |

*Primary Examiner*—Peter Chin

*Attorney, Agent, or Firm*—Bacon & Thomas

[57] ABSTRACT

This invention relates to paper-making and in particular to non-fluorescent forgery-proof safety paper which is characterized in that it comprises, on its surface and/or in its mass, a salt of cobalt(II) or (III), at least partially soluble in aqueous phase.

9 Claims, No Drawings

NON-FLUORESCENT FORGERY-PROOF SAFETY PAPER AND DOCUMENT OBTAINED

FIELD OF THE INVENTION

The present invention relates to non-fluorescent, forgery-proof safety paper and document obtained The invention relates to the domain of papermaking and particularly to a safety paper presenting a sensitivity to chemical agents likely to be used for falsifying the inked printing or writing by chemically bleaching the inks More especially, this invention concerns the domain of safety papers used for producing handwritten negotiable instruments and official documents which must be protected from any attempt at alteration with the aid of chemical reagent.

BACKGROUND OF THE INVENTION

Safety papers have already been proposed, comprising chemical reagents to the oxidizing-reducing agents used in eradicator products, such as those marketed under the name of "CORECTOR" or "SLOAN'S". Such fluorescent papers generally develop, upon contact with these oxidizing-reducing products, a colouring which is often slight, hardly visible or invisible to the naked eye, but representing, on the other hand, an inconvenience for certain uses in which, in particular, the non-fluorescence of the paper is, on the contrary, desired, for example as monitoring means.

A paper containing chemical reagents to acids, to alkalis, to chlorinated bleaching reagents, to ink eradicators, is also known. Particular mention may be made of the teaching furnished by Patents FR 2 365 656, 2 399 505 and FR 2 402 739. Papers thus treated do not provide a suitably distinct coloured reaction.

Another proposition has also been made by Patent FR 2 580 303, providing the incorporation of iron(III) and a stabilizing agent giving a coloured complex with iron(II). The recommended method is delicate to carry out, involves products of high cost and leads to a paper which initially presents a background colouring which, moreover, tends to accentuate with age. A paper according to such a proposition presents, in addition, a reactivity limited to the pair of oxidizing-reducing agents, which reduces its forgery-proof characteristics.

The present invention aims at proposing a novel safety paper which responds better than heretofore to the different requirements of a forgery-proof safety paper and which may easily be manufactured in accordance with traditional methods and at an advantageous cost price.

It is an object of the invention to provide a forgery-proof safety paper not presenting any noteworthy residual colouring, nor fluorescence, capable of reacting to chemical reducing agents, to the pair of oxidizing-reducing agents, as well as to the eradicator felts, with a sufficiently high sensitivity to satisfy the relevant harsh tests.

It is another object of the invention to provide a forgery-proof safety paper presenting, after treatment, a clear white colouring not undergoing substantial alteration in the usual storage time at the consumer's.

It is a further object of the invention to propose a forgery-proof safety paper whose sensitivity of reaction to the pair of oxidizing-reducing agents is improved.

SUMMARY OF THE INVENTION

To attain the purposes set forth hereinabove, the forgery-proof safety paper according to the invention is characterized by the presence, on its surface and/or in its mass, of a salt, soluble or partially soluble in aqueous phase, of cobalt(II) or (III). The soluble salt of cobalt may therefore be supplied in various ways, for example:

by coating in accordance with known methods,
by addition in the mass,
by impregnation.

The term paper should be understood to mean any substrate having a composition based on cellulosic and/or synthetic fibers, without excluding the supports constituted by a film and comprising, or not, the conventional paper-making additives.

The preferred salts of cobalt which are particularly suitable, are the following:

heptahydrated sulfate of cobalt(II),
acetate of cobalt(II),
nitrate of cobalt(II),
chloride of cobalt(II),
acetylacetonate of cobalt(III).

The quantity of cobalt salt having to be added essentially depends on the desired colouring in reaction. It appears that an addition, from 0.2% by dry weight with respect to the weight of paper, already produces, in the presence of a reactive chemical agent, a colouring observable to the naked eye.

Industrially, between 0.5 and 1%, currently 0.6% by dry weight of cobalt salt with respect to the weight of paper, is used.

Two examples illustrating two processes for treating a paper of the forgery-proof cheque type, with a G.S.M. equal to 95 g/m$^2$ and fundamentally white in colour, are given hereinafter.

EXAMPLE 1

On such a non-treated paper there is deposited, by surface coating, a solution comprising, per liter of water:

| | |
|---|---|
| sulfate of cobalt (II) | 15 g |
| starch | 100 g |

at the rate of 40 g/m$^2$.

The white paper thus treated, non-fluorescent, reacts by developing an orange colouring with the chemical reducing agents, sulfite, sodium bisulfite and the ink eradicator felts, and a greeny-beige colouring with hypochlorite of soda.

EXAMPLE 2

On a paper support of the same type there is deposited, by surface coating, at the rate of 40 g/m$^2$, a solution comprising, per liter of water:

| | |
|---|---|
| sulfate of cobalt (II) | 20 g |
| sulfate of manganese | 10 g |
| starch | 100 g |

The white paper thus treated, non-fluorescent, by presenting the following colouring:

orange with the reducing agents, sodium sulfite, sodium bisulfite and the ink eradicator felts,
brown with hypochlorite of sodium and the bases.

In accordance with a development of the invention, in order to reinforce the sensitivity to the oxidizing-reducing pair, it is provided to associate with the cobalt salt, at least partially soluble in aqueous phase, one or more co-reagents or sensitizing agents, of reducing character, among which those of phenolic structure are preferred.

Among these co-reagents, those responding to the structure:

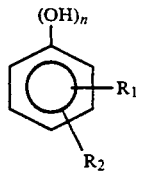

are preferably employed, with:

n=1, 2 or 3

$R_1$=H, $NH_2$, $OCH_3$, COOH, $SO_3H$, $CH_3$, COOR (with R representing an aromatic or aliphatic radical, substituted or not), $R_2$=H, $CH_3$, $OCH_3$, COOH, $NH_2$, $SO_3H$.

Significant and interesting examples are the following:

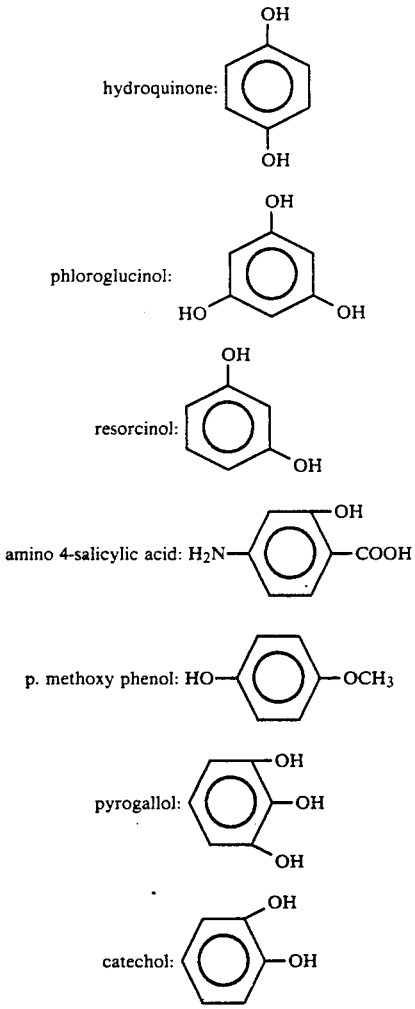

The quantity of co-reagent may vary from 0.5% by dry weight with respect to the weight of paper, as a function of the desired reactive colouring, particularly its density, up to a maximum quantity defined, as is known to the man skilled in the art, to take into account the production cost, preferably whilst respecting the white ground colour of the paper.

Industrially, 1% by dry weight of cobalt salt and 0.8% of co-reagent with respect to the weight of paper are currently introduced, in order to obtain a difference between the paper ground and the reactive colouring with one of the following reagents: sodium sulfite, oxidizing-reducing pair, Javelle water, at least equal to 10 units assessed in the L.a.b. system set up by the International Commission on Illumination in 1976.

Some examples of compositions for treating a paper, of forgery-proof cheque type, with G.S.M. of 95 g/m$^2$ and fundamentally white in colour, containing, or not, the traditional additives, particularly in the domain of forgery-proof safety papers, will be given hereinafter:

EXAMPLE 3

The paper support is surface-treated with a solution comprising, per liter of water:

heptahydrated sulfate of cobalt(II) 30 g
hydroquinone 20 g
starc h 200 g

Absorption is about 40% with respect to the weight of paper which is dried in conventional manner.

Such a paper presents a yellow-orange reactive colouring after encounter with the oxidizing-reducing pair: potassium permanganate - sodium bisulfite, for example by an immersion of 15 seconds in a 50 g/l potassium permanganate solution followed by draining for about a minute, after which the paper is immersed in a 10–15 g/l sodium bisulfite solution before being dried in the open air.

A paper, such as hereinabove, also presents an orange coloured reaction in the presence of reducers alone, such as bisulfite in aqueous solution, neutral sulfite, in the presence of ink eradicator felts, a greeny-beige coloured reaction in the presence of hypochlorite of soda and a brown reaction in the presence of strong basic agents such as sodium hydroxide or sodium carbonate.

EXAMPLE 4

On a support, of the same type as that of Example 1, there is deposited, on the surface, a coating solution comprising, per liter of water:

| | |
|---|---|
| acetate of cobalt | 20 g |
| phloroglucinol | 5 g |
| starch | 200 g |

The non-fluorescent white paper obtained reacts, in the presence of the chemical agents described in the preceding Example, by developing the same colours.

EXAMPLE 5

On the same non -treated paper support there is deposited, on the surface, the coating solution comprising, per liter of water:

| | |
|---|---|
| nitrate of cobalt (II) | 15 g |
| resorcinol | 20 g |
| sulfate of manganese | 10 g |
| starch | 150 g |

The non-fluorescent white paper obtained reacts with the oxidizing-reducing pair, with the reducers, with the eradicator felts, giving a clearly visible yellow-orange colouring on the paper.

With hypochlorite of soda and the bases, an intense brown colour is formed.

EXAMPLE 6

On the same paper support, containing reagents in the mass, such as ferric salt and precipitate of manganese ferocyanide, one or more dispersed organosoluble colorants, and treated by coating with a solution identical to that of Example 1, it is possible to obtain, in addition, reaction with the acids which form on the paper a blue colour and reactions with the solvents which produce colourings which vary depending on their nature and the organosoluble colorants.

EXAMPLE 7

On a paper support, manufactured in a neutral medium, there is deposited the coating solution comprising, per liter of water:

| | |
|---|---|
| chloride of cobalt (II) | 25 g |
| hydroquinone | 20 g |
| starch | 100 g |

The whiteness and reactivity of the final product are identical to those of Example 5.

EXAMPLE 8

By proceeding as in Example 1 and by recycling in the mass 5 to 10% of cassie paper of preceding productions, the whiteness and reactivity of the final product are not affected.

EXAMPLE 9

By proceeding as in Example 1, but replacing the starch by a polyvinyl alcohol as coating binder, at a rate of 20 g/l of solution, the same colourings are obtained on the safety paper thus prepared.

EXAMPLE 10

On a non-treated paper support is deposited, on the surface, a solution containing, per liter of water:

| | |
|---|---|
| acetylacetonate of cobalt (III) | 70 g |
| hydroquinone | 40 g |
| catechol | 40 g |
| sulfate of manganese | 40 g |
| starch | 200 g |

The non-fluorescent paper thus treated reacts by developing an orange colouring with the oxido-reduction combinations of the type: application of solution of potassium permanganate then application of bisulfite of sodium, the hypochlorite of soda develops a blackish-brown colouring.

It must be considered that the invention also encompasses any coloured paper which is not fundamentally white, and treated to comprise, in the mass or on the surface, a soluble salt of cobalt.

What is claimed is:

1. A method for detecting the use of a chemical erasing material on paper; said method comprising the steps of adding a salt of cobalt (II) or (III) and a co-reactant to the paper; said co-reactant being of reducing character and a phenolic structure; and said cobalt salt and co-reactant being at least partially soluble in aqueous phase; and then detecting the use of a chemical erasing material on the paper by visually inspecting the paper for a color change produced by a reaction between the chemical erasing material and the cobalt salt and co-reactant contained in the paper.

2. The method of claim 1 wherein the cobalt salt is present in an amount at least equal to 0.2% by dry weight with respect to the weight of the paper and said co-reactant is present in an amount at least equal to 0.5% by dry weight with respect to the weight of the paper.

3. The method of claim 1 wherein the co-reagent is:

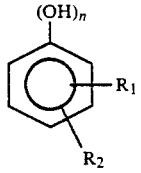

wherein:

n is 1, 2 or 3, $R_1$ is H, $NH_2$, $OCH_3$, COOH, $CO_3H$ $CH_3$ or COOR, wherein R represents an aromatic or aliphatic radical which may be substituted or unsubstituted, and $R_2$ is H, $CH_3$, $OCH_3$, COOH, $NH_2$ or $SO_3H$.

4. The method of claim 3 wherein the co-reagent is hydroquinone, phloroglucinol, resorcinol, amino-4-salicylic acid, p-methoxy-phenol, pyrogallol or catechol.

5. The method of claim 2 wherein the cobalt salt is present in an amount of between 0.5% and 1.0%.

6. The method of claim 2 wherein the cobalt salt is heptahydrated sulfate of cobalt (II), nitrate of cobalt (II), acetate o cobalt (II), chloride of cobalt (II), or acetylacetonate of cobalt (III).

7. The method of claim 3 wherein the soluble salt of cobalt is heptahydrated sulfate of cobalt (II), nitrate of cobalt (II), acetate of cobalt (II), chloride of cobalt (II), or acetylacetonate of cobalt (III).

8. The method of claim 5 wherein the soluble salt of cobalt is heptahydrated sulfate of cobalt (II), nitrate of cobalt (II), acetate of cobalt (II), chloride of cobalt (II), or acetylacetonate of cobalt (III).

9. A method for detecting forgery of a paper document which comprises forming the paper into a document by applying an inked message thereon and then visually inspecting the document for any change in color; said paper containing a salt of cobalt (II) or (III) and a co-reactant of reducing character and of phenolic structure, which are at least partially soluble in aqueous phase.

* * * * *